US006527340B1

(12) United States Patent
Finch et al.

(10) Patent No.: US 6,527,340 B1
(45) Date of Patent: Mar. 4, 2003

(54) APPARATUS AND METHOD FOR TILTING THE SEAT OF A WHEELCHAIR WITH A LOW PROFILE LINKAGE

(75) Inventors: Thomas E. Finch, San Antonio, TX (US); James E. Finch, San Antonio, TX (US)

(73) Assignee: Teftec Corporation, San Antonio, TX (US)

( * ) Notice: Subject to any disclaimer, the term of this patent is extended or adjusted under 35 U.S.C. 154(b) by 0 days.

(21) Appl. No.: 09/818,114

(22) Filed: Mar. 27, 2001

Related U.S. Application Data

(60) Provisional application No. 60/192,302, filed on Mar. 27, 2000.

(51) Int. Cl.[7] ..... A47C 1/024

(52) U.S. Cl. ..... 297/330; 297/DIG. 4; 280/250.1

(58) Field of Search ..... 297/330, DIG. 4; 280/250.1; 248/631, 421

(56) References Cited

U.S. PATENT DOCUMENTS 4,046,418 A * 9/1977 Smith et al. ..... 297/DIG. 4 X
4,591,182 A * 5/1986 Wood ..... 297/DIG. 4 X
4,679,849 A * 7/1987 Torgny ..... 297/330
4,684,171 A * 8/1987 Roy et al. ..... 280/250.1
5,020,816 A * 6/1991 Mulholland ..... 280/250.1
5,240,277 A * 8/1993 Scheulderman ..... 280/250.1 X
5,297,021 A * 3/1994 Loerlin et al. ..... 297/DIG. 4 X
5,513,867 A * 5/1996 Bloswick et al. ..... 280/250.1
5,790,997 A * 8/1998 Ruehl ..... 297/330 X

FOREIGN PATENT DOCUMENTS

DE 25 17 418 * 4/1976 ..... 297/DIG. 4

* cited by examiner

*Primary Examiner*—Peter M. Cuomo
*Assistant Examiner*—Rodney B. White
(74) *Attorney, Agent, or Firm*—Cox & Smith Incorporated

(57) ABSTRACT

A tilt seat mechanism for a wheelchair that includes a base frame and a seat frame that are nested and parallel in a first position and separated and angled in a second position. The seat frame is rotated about a pivot on the base frame by an electrically driven jackscrew. The drive linkage comprises a crossbar connected to the end of the jackscrew and a pair of tee-head connecting links that move with the crossbar. The ends of the crossbar move in channels on the base frame and pivotally connect to the tee-head links. The connecting links are pivotally attached to a bracket fixed on the seat frame. As the jackscrew turns it moves the crossbar and connecting links out from a closed position. This movement results in the lifting of the seat platform to a reclining position with respect to the horizontal base frame.

1 Claim, 7 Drawing Sheets

APPARATUS AND METHOD FOR TILTING THE SEAT OF A WHEELCHAIR WITH A LOW PROFILE LINKAGE

RELATIONSHIP TO PRIOR APPLICATIONS

The present application claims the benefit of the filing date of U.S. Provisional Patent Application Serial No. 60/192,302 filed Mar. 27, 2000.

BACKGROUND OF THE INVENTION

1. Field of the Invention

The present invention relates generally to components and structures for wheelchairs. The present invention relates more specifically to mechanisms for retaining, supporting and tilting the seat platform of a wheelchair.

2. Description of the Related Art

It is desirable in many uses of a wheelchair to be able to move the seat platform of the chair to a reclining position. Efforts to achieve this capability have frequently failed to provide both a durable tilting framework and a low profile structure. Effective mechanisms typically have excessive structural requirements while low profile systems typically fail to operate very effectively.

It would be desirable to have a low profile seat tilting mechanism that operated smoothly and efficiently without the need for excessive power motor requirements. It would be desirable if such a low profile seat tilting mechanism could move the seat platform of the wheelchair through at least sixty (60) degrees of effective rotation or tilt. It would be desirable if such a mechanism could be implemented in a minimal amount of space below or within the seat platform of the wheelchair. Finally it would be desirable if such a tilt system provided stability to the seat platform throughout the range of motion possible.

SUMMARY OF THE INVENTION

It is therefore an object of the present invention to provide a tilt mechanism for a wheelchair seat platform that is both durable and low in profile.

It is an object of the present invention to provide a tilt seat mechanism for a wheelchair that provides a stabile range of motion of at least sixty (60) degrees from the horizontal to the inclined.

It is a further object of the present invention to provide a tilt seat mechanism for a wheelchair that incorporates a linkage system that minimizes the motorized power required to effect tilting movement of the seat platform.

It is a further object of the present invention to provide a tilt seat mechanism for a wheelchair that is rugged and durable in the face of repeated use and yet does not require excessively heavy linkage members and frame supports.

In fulfillment of these and other objectives the present invention provides an improved tilt seat mechanism for a wheelchair that is structurally durable, operationally effective, and yet low in profile, adding very little to the overall framework of the chair platform. The mechanism structure includes a base frame and a seat platform frame that are nested and parallel in a first position and separated and at an angle of sixty (60) degrees or more in a second position. The seat platform component is rotated about a pivot point on and with respect to the base frame, by an electrically driven jack-screw with a unique linkage between the frame components. The linkage comprises a movable cross bar connected to the end of the jack-screw as well as a pair of tee-head connecting links that move with the crossbar. The ends of the cross bar move in channels on the base frame and pivotally connect to the tee-head connecting links. The connecting links are each pivotally attached to a transverse lever bracket fixed on the seat platform frame. As the jack-screw turns it moves the cross bar and connecting links forward or out from a "closed" position. Due to the placement of the pivot point for the seat platform frame, the movement of the connecting links outward pulls on the lever bracket of the platform frame and rotates the seat platform frame around the pivot point. This rotation results in the lifting of the seat platform to a reclining position with respect to the typically horizontal base frame.

DETAILED DESCRIPTION OF THE PREFERRED EMBODIMENTS

Figure 1:
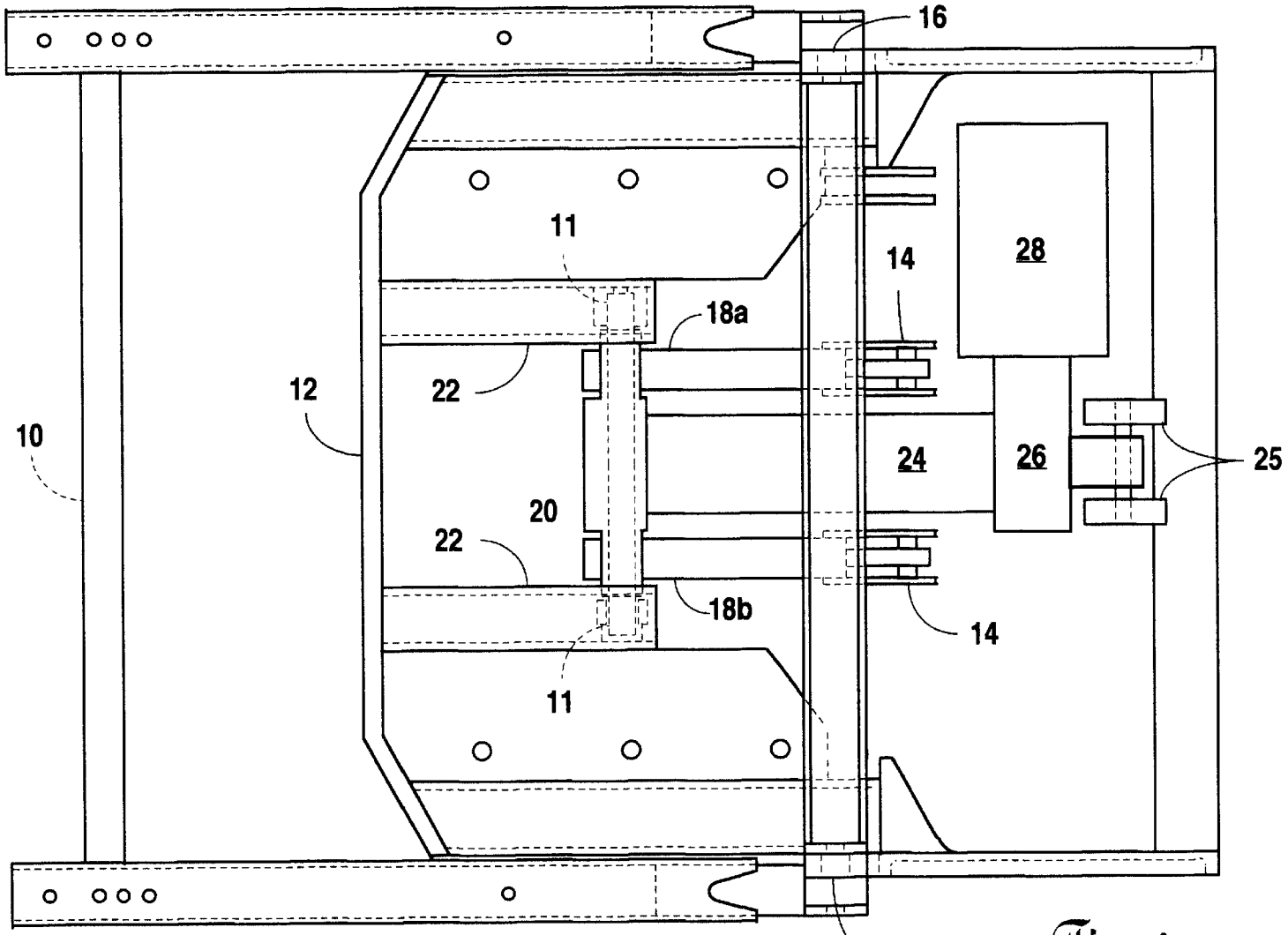
FIG. 1 is a top plan view of the assembly of the present invention in a lowered condition.

Reference is made first to FIG. 1 for a general description of the complete assembly of the present invention and the various linkages that implement its tilting motion. Initially it is understood that the assembly of the present invention as shown in FIG. 1 would be positioned on a wheelchair frame in support of a seat structure for receiving the occupant of the wheelchair. The present invention would typically be used in conjunction with an electric motorized wheelchair powered by batteries or the like. The structure of the present invention would be fixed to the wheelchair carriage in a manner well known in the art and would receive and fix the chair or seat structure of the wheelchair, again in a manner well known in the art.

The assembly of the present invention as shown in FIG. 1 is comprised primarily of seat platform frame 10 and base frame 12. In the closed or horizontal condition shown in FIG. 1, base frame 12 is nested within and parallel to seat platform frame 10. The two frames are pivotally attached to each other at pivot points 16. These pivot points 16 allow seat platform frame 10 to be raised in a rotational manner to an inclined position with respect to generally horizontal base frame 12.

Seat platform frame 10 incorporates a transverse component that extends over and across base frame 12 and incorporates two lever brackets 14. This transverse component of seat platform frame 10 receives most of the torsional forces involved in tilting the seat platform and is therefore constructed of a relatively rugged grade metal stock or the like. Lever brackets 14 are rigidly fixed to the transverse component of seat platform frame 10 and move with platform frame 10 during the tilting process. Lever brackets 14 are each pivotally linked to tee-head connecting links 18*a* and 18*b* in a manner described in more detail below.

At the opposite end of each of tee-head connecting links 18*a* and 18*b* are additional pivoting connection points to cross bar 20. Cross bar 20 is essentially a moveable axle that pivotally engages tee-head connecting links 18*a* and 18*b* adjacent opposing ends of cross bar 20. At the extreme ends of cross bar 20 are positioned channel bushings 11 which permit the sliding movement of the ends of cross bar 20 within channels 22. Channels 22 are positioned on and fixed to base frame 12 and remain horizontal (coplanar with base frame 12) during the tilting operation.

Cross bar 20 is linked at its center to jack screw 24 which extends parallel to tee-head connecting links 18*a* and 18*b,* back towards the drive mechanism for the assembly. The end of jack screw 24 that is connected to cross bar 20 is the movable end of the jack screw, serving to move cross bar 20 along channels 22 as shown. The fixed end of jack screw 24 is attached to base frame 12 at jack screw fixed yoke 25. Intermediate to this fixed end of jack screw 24 is worm gear 26 which couples electric motor 28 to jack screw 24.

The assembly described above operates in the following manner. Activation of electric motor 28 (by an appropriate electrical switch) turns worm gear 26 which drives jack screw 24. Movement of jack screw 24 displaces cross bar 20 "forward" in channels 22 by means of channel bushings 11. As a result, cross bar 20 pulls tee-head connecting links 18*a* and 18*b* forward with it. As tee-head connecting links 18*a* and 18*b* move forward, they pull on lever brackets 14 which are fixed to the transverse component of platform frame 10. This lever action on seat platform frame 10 causes a rotation of the platform about pivot points 16 thus raising the platform to an inclined angle with respect to base frame 12.

Figure 2:
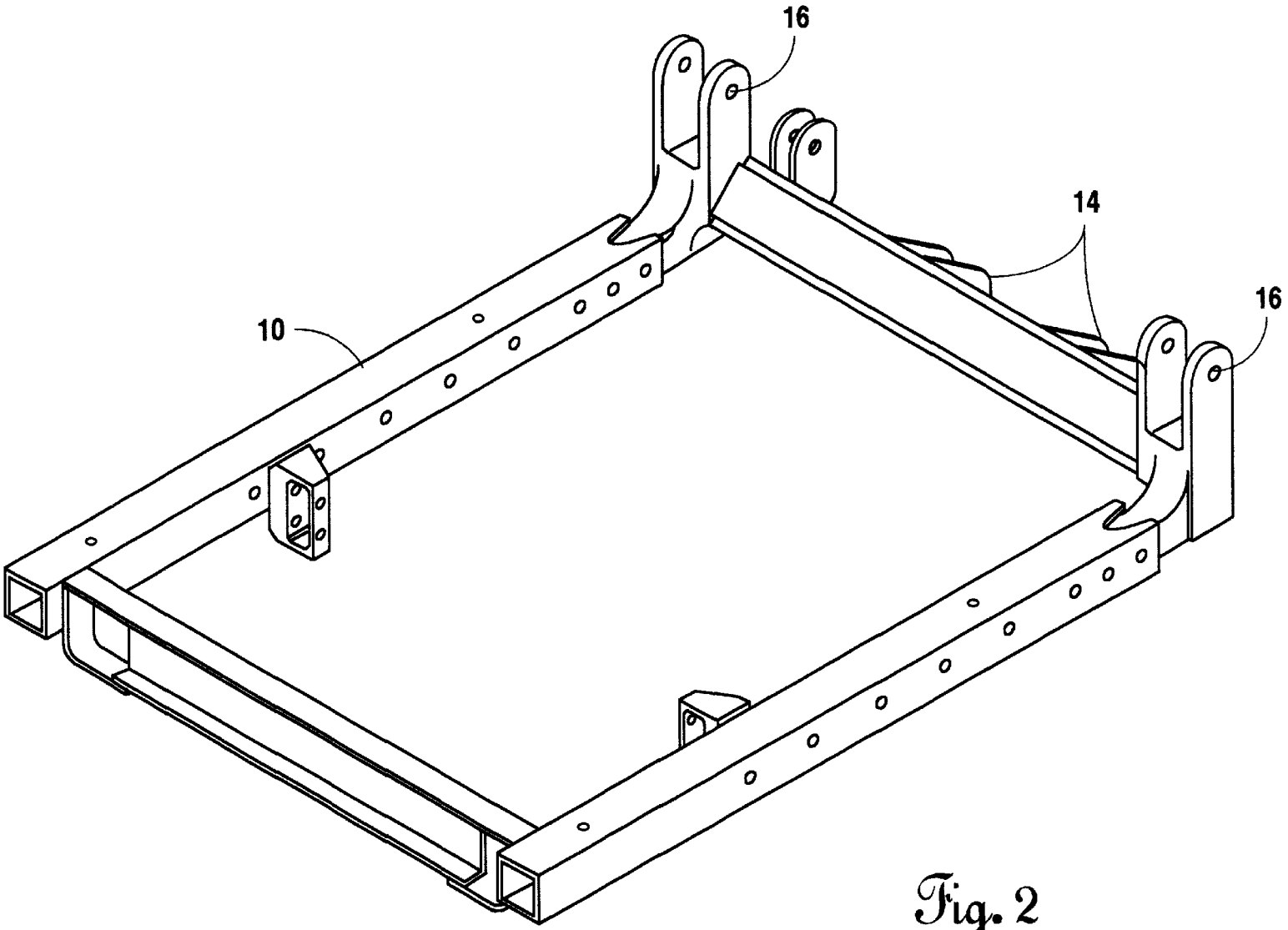
FIG. 2 is a perspective view of the seat platform frame component of the present invention.

Reference is now made to FIG. 2 for a brief description of the structure of seat platform frame 10. As shown in FIG. 2, seat platform frame 10 is essentially a rectangular metal frame adjustable in a number of aspects and suitable for the retention of the seat platform for a typical electric wheelchair. Pivot points 16 are shown constructed from yoke configurations that serve to receive matching pivot points on base frame 12. The transverse component of seat platform frame 10 is shown in this perspective view connecting pivot points 16 on either side. Positioned behind the transverse component of seat platform frame 10 are lever brackets 14, partially hidden in this view.

Figure 3A:
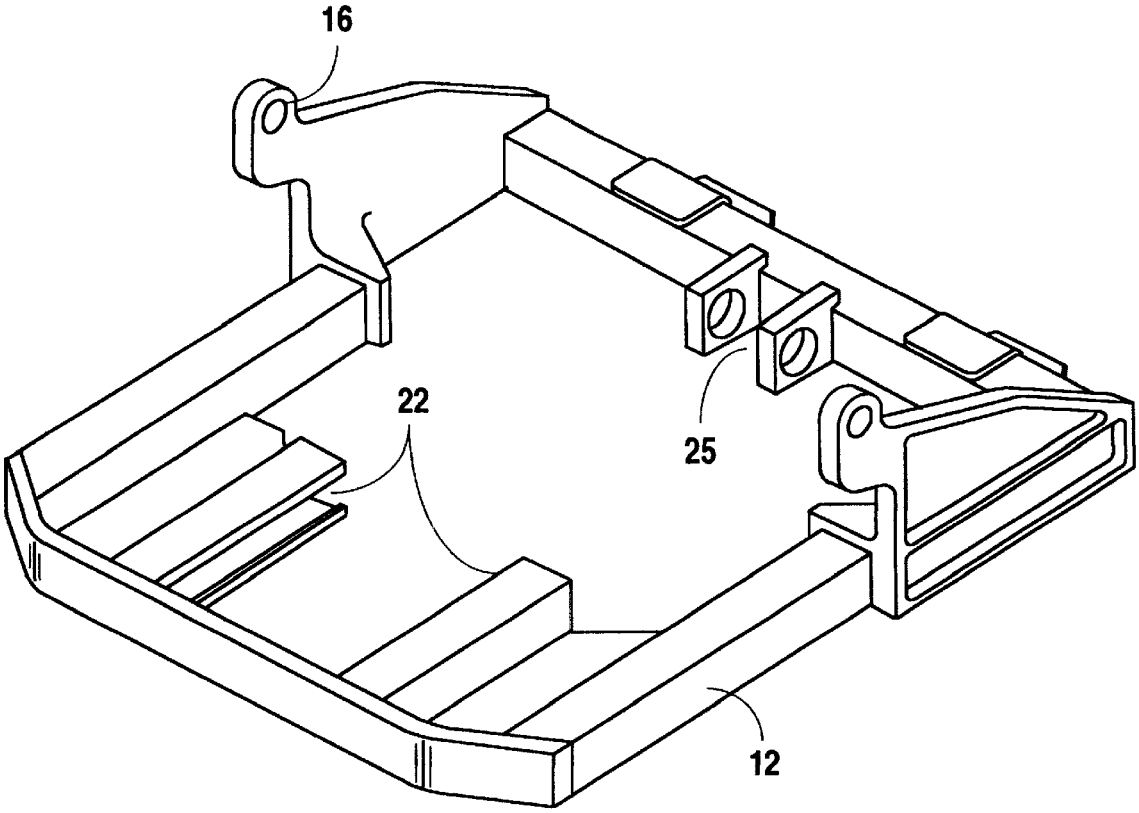
FIGS. 3*a*–3*b* are detailed perspective and detailed side views respectively of the base frame component of the present invention.
Figure 3B:
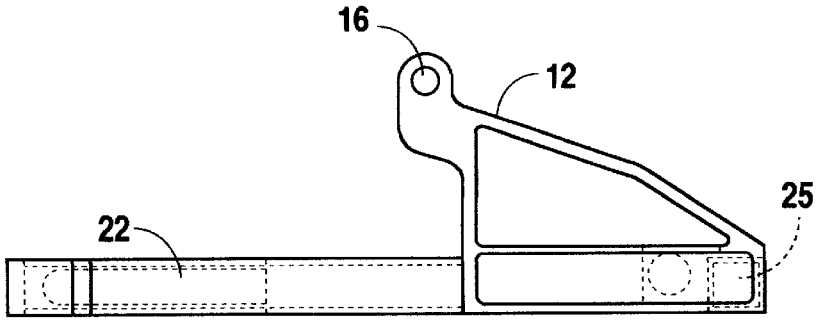

FIGS. 3*a* and 3*b* show in greater detail the structure of base frame 12. In FIG. 3*a,* pivot points 16, positioned on either side of base frame 12, are shown appropriately aligned to insert into the pivot point yokes shown on seat platform frame 10 in FIG. 2. Open channels 22 are shown positioned to receive channel bushings 11 and the associated cross bar 20. Jack screw yoke 25 is positioned on a rear transverse component of base frame 12 where it suitably fixes one end of jack screw 24.

Once again, base frame 12 is to be permanently mounted or fixed to the carriage of the electric wheelchair. Appropriate apertures and plates for such a mounting are provided.

Figure 4A:
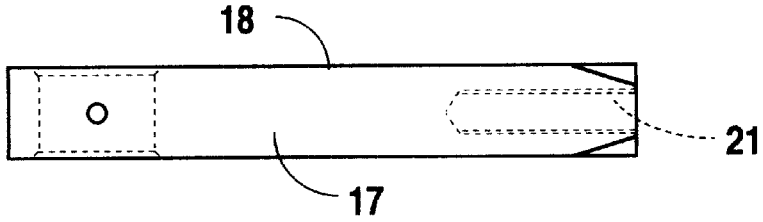
FIGS. 4*a*–4*d* are detailed side views of the connecting link components of the present invention.
Figure 4B:
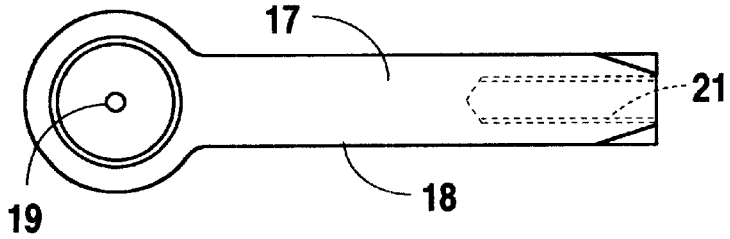
Figure 4C:
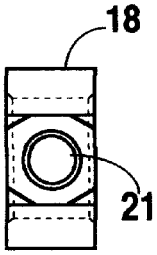
Figure 4D:
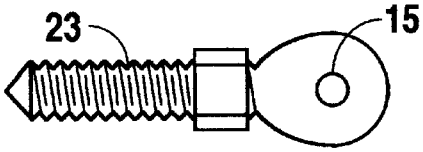

Reference is now made to FIGS. 4*a* through 4*d* for a brief description of the structural components of tee-head connecting links 18*a* and 18*b*. FIGS. 4*a* through 4*c* disclose in a number of views the structure of bar component 17 of connecting link 18. At one end of bar component 17 is cross bar aperture 19 which is a cylindrical aperture sized and shaped to receive cross bar 20 as described above. At an opposite end of bar component 17 is threaded aperture 21 which serves to receive adjustable link eye 23 shown in FIG. 4*d*. Adjustable link eye 23 may be adjustably screwed into threaded aperture 21 and held fixed at a specific length. Lever bracket aperture 15 on adjustable link eye 23 is then positioned to engage lever bracket pins that pivotally connect connecting links 18*a* and 18*b* to lever brackets 14 shown in FIG. 1.

Figure 5A:
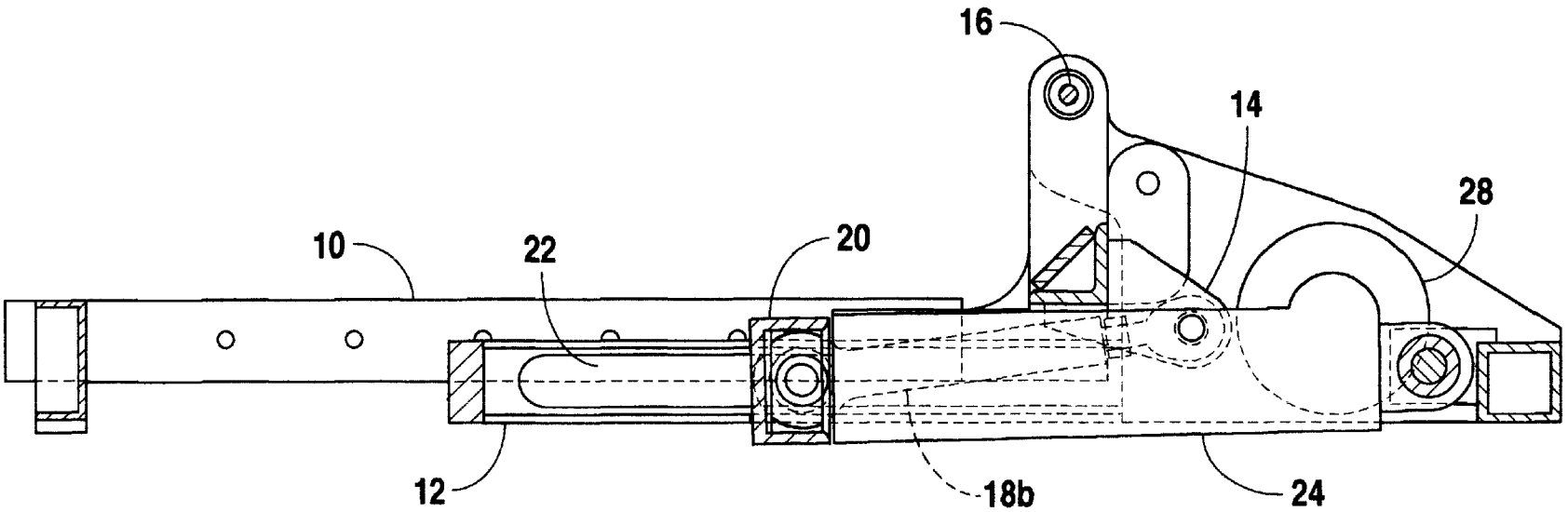
FIGS. 5*a*–5*c* are partial cross sectional side views of the assembly of the present invention in three different tilt configurations.
Figure 5B:
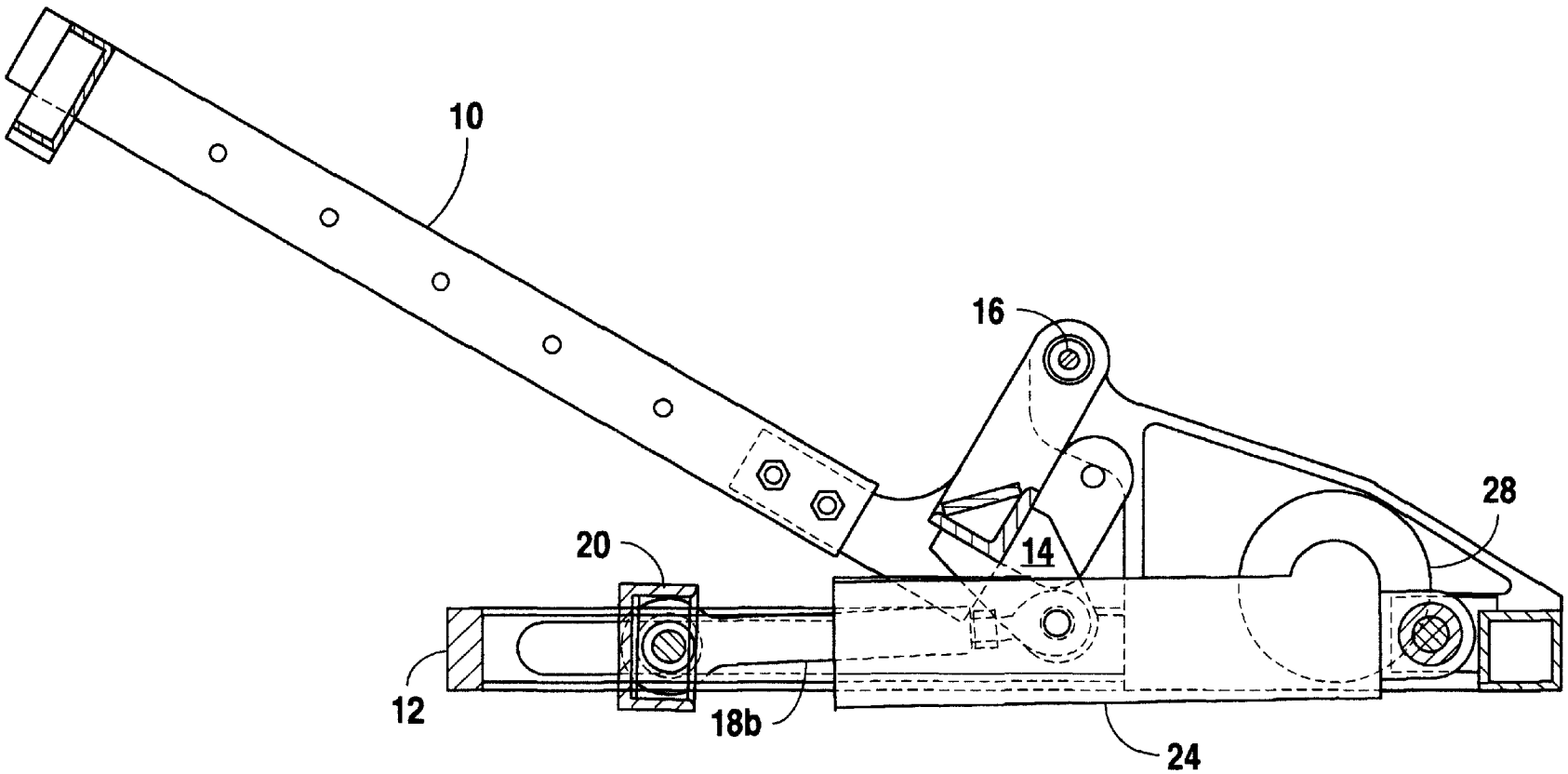
Figure 5C:
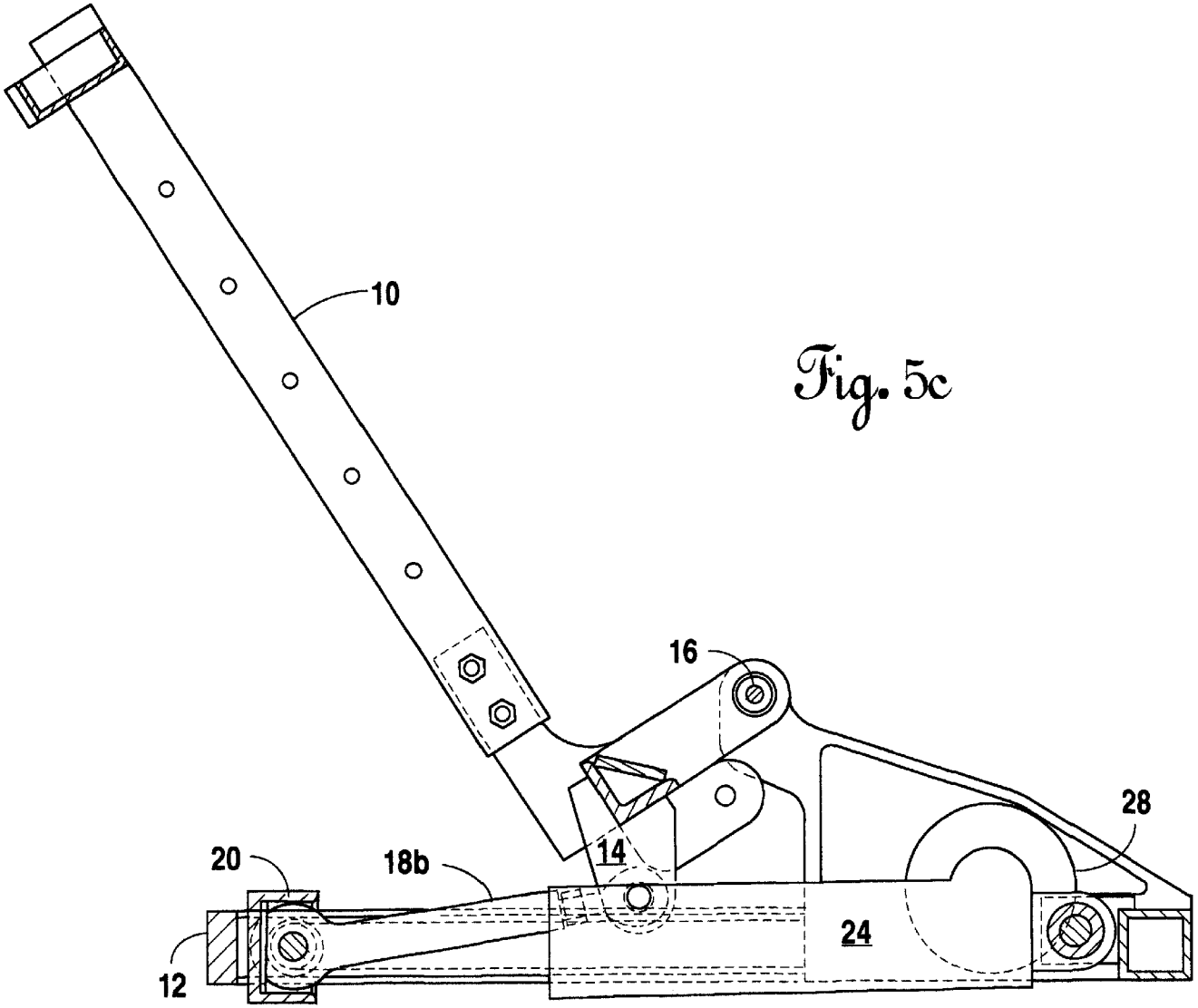

Reference is now made to FIGS. 5*a* through 5*c* for a description of the functioning of the tilt seat mechanism of the present invention and its configuration in a lowered, a middle, and a raised position. FIG. 5*a* shows in a partial cross sectional side view the configuration of the assembly in a lowered position. In this view, seat platform frame 10 is generally parallel to and coplanar with base frame 12. Pivot point 16 matches the respective pivot point components on seat platform frame 10 and base frame 12 and provides the rotational pivot point for the rotational movement of seat platform frame 10 with respect to base frame 12. Lever bracket 14 is shown fixed on seat platform frame 10 and connected to connecting link 18*b* (in this view). Similar connections would be made to connecting link 18*a* on an opposite side of the assembly.

Cross bar 20 is seen in its diametrical cross section, positioned to travel along channel 22 at the urging of jack screw 24 positioned at its center. Jack screw 24 is driven by electric motor 28 through the linkages described above. Movement of cross bar 20 in channel 22 draws connecting link 18*b* forward (to the left in FIG. 5*a*) which in turn draws lever bracket 14 downward and forward in a clockwise rotational direction in this view. This tends to force seat platform frame 10 upward with respect to base frame 12.

In FIG. 5*b* the tilting process has been carried out through approximately half of its range. In this view, connecting link 18*b* is shown directed forward and pulling on lever bracket 14 in the process. Jack screw 24 has forced cross bar 20 forward in channel 22 in base frame 12. This causes the clockwise rotation (in this view) of seat platform frame 10 about pivot point 16 connected to base frame 12.

Finally, in FIG. 5*c* the assembly is shown in its most extreme tilting position (approximately 60 degrees from horizontal). In this view, connecting link 18*b* has been pulled completely forward with cross bar 20 reaching its limit in channel 22. In this manner, lever bracket 14 has been rotated from a nearly horizontal orientation (FIG. 5*a*) to a nearly vertical orientation. Jack screw 24 has reached its fullest extent forcing cross bar 20 forward, guided by channel bushings 11 which move within channels 22.

Many features and advantages of the present invention are discernable from the detailed specification and the attached figures. It is therefore intended by the appended claims to cover all such features and advantages of the invention that fall within the spirit and scope of the invention. Furthermore, since numerous modifications and variations will readily occur to those skilled in the art, it is not desired that the present invention be limited to the exact construction and operation illustrated and described herein. Accordingly therefore, all suitable modifications and equivalents that may be resorted to are intended to fall within the scope of the claims. Although the invention has been described with reference to specific embodiments, this description should not be construed as limiting. Various modifications of the disclosed embodiments, as well as alternative embodiments of the inventions will become apparent to persons skilled in the art upon reference to the description of the invention. It is, therefore, contemplated that the appended claims will cover such modifications that fall within the scope of the invention.

We claim:

1. A device for tilting the seat of a wheelchair from a normal sitting position to an inclined position, said device comprising:

(a) a base frame defining and disposed generally within a first plane;

(b) a seat platform frame pivotally connected to said base frame about at least one pivot point and comprising at least one lever arm, said seat platform movable between being disposed generally within a second plane, generally parallel with said first plane and a third plane generally non-parallel to said first plane;

(c) at least one linkage arm having a first end and a second end, said linkage arm pivotally connected at said first end to said at least one lever arm of said seat platform; and (d) a linear displacement drive mechanism generally disposed parallel with said first plane and connected to said at least one linkage arm at said second end thereof and to said base frame for effecting a linear displacement of said linkage arm with respect to said base frame, thereby effecting a rotational torque on said at least one lever arm of said seat platform, thereby effecting a rotational movement of said seat platform with respect to said base frame about said pivot point, said linear displacement of said linkage arm at said second end thereof occurring generally parallel with said first plane.

* * * * *